United States Patent [19]

Carminati et al.

[11] Patent Number: 4,773,630

[45] Date of Patent: Sep. 27, 1988

[54] TANK FURNACE FOR THE METALLURGICAL TREATMENT OF NON-FERROUS METALS

[75] Inventors: Antonio Carminati, Milan; Andrea Perillo, Rome, both of Italy

[73] Assignee: Shamprogetti S.p.A., Milan, Italy

[21] Appl. No.: 95,058

[22] Filed: Sep. 2, 1987

[30] Foreign Application Priority Data

Sep. 2, 1986 [IT] Italy ..... 21565 A/86

[51] Int. Cl.[4] ..... C21B 7/06

[52] U.S. Cl. ..... 266/285; 266/214

[58] Field of Search ..... 266/280, 286, 285, 214; 432/251

[56] References Cited

U.S. PATENT DOCUMENTS

| | | | |
|---|---|---|---|
| 1,738,527 | 12/1929 | Dobie | 266/285 |
| 2,182,674 | 12/1939 | Morton | 432/251 |
| 3,282,580 | 11/1966 | Brazill et al. | 266/214 |

*Primary Examiner*—L. Dewayne Rutledge
*Assistant Examiner*—S. Kastler
*Attorney, Agent, or Firm*—Birch, Stewart, Kolasch & Birch

[57] ABSTRACT

A tank furnace for the metallurgical treatment of non-ferrous metals, consisting of a refractory hearth in the form of an inverted arch disposed on perimetral plate assemblies which are able to move in order to compensate for hearth expansion, a containing belt formed of metal box elements, and walls and a crown of refractory material, said elements being separately supported by an external frame and being able to slide relative to each other due to thermal expansion.

8 Claims, 4 Drawing Sheets

Fig.4
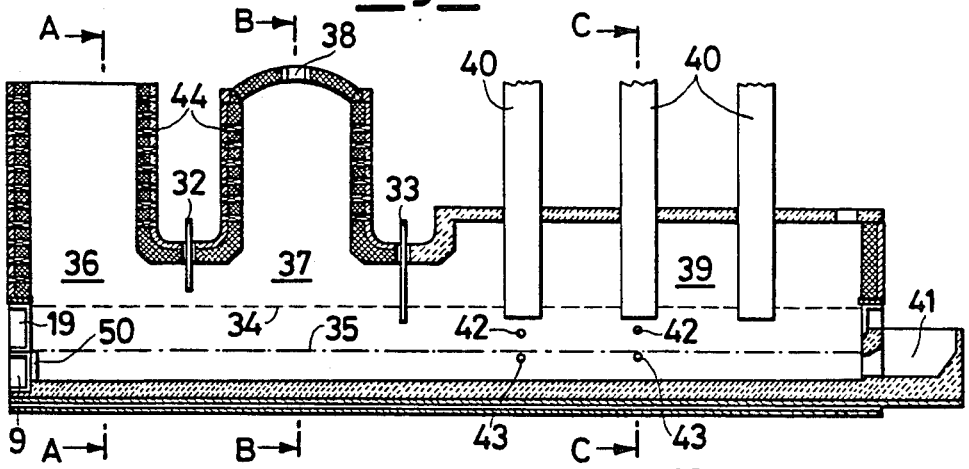
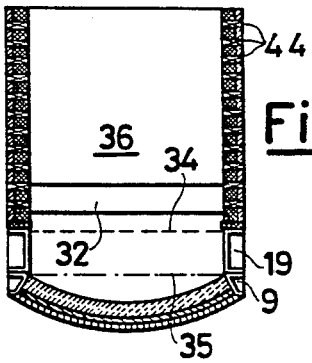
Fig.4A
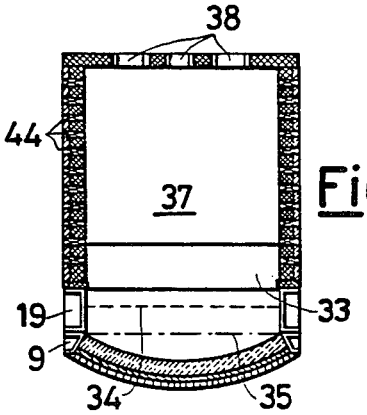
Fig.4B
Fig.4C
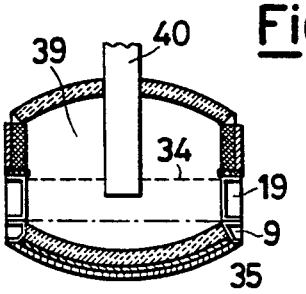
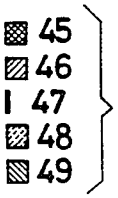
Fig.4D

TANK FURNACE FOR THE METALLURGICAL TREATMENT OF NON-FERROUS METALS

This invention relates to a tank furnace for the metallurgical treatment of non-ferrous metals. The metallurgical treatment of non-ferrous metals, such as lead, zinc and copper, is mainly concerned with mineral sulphides of these metals, and comprises the steps of oxidising such sulphides to oxides and/or sulphates, followed by their reduction to the crude elemental state by a series of very complex reactions, which are further complicated by the fact that non-ferrous metal ores are nearly always associated with each other and that technical and economical considerations require their separation and recovery.

Before the actual metallurgical stage, the ore is prepared by reducing it to the required particle size, freeing it from the gangue, separating the various mutually associated ores—for example by flotation—and then reducing their moisture content. The metallurgical stage as far as the production of the metal in its crude elemental state by the previously mentioned steps is carried out by conventional processes either in separate furnaces or in the case of the most recent processes in a single furnace, but in any event operating on stratified liquid phases, of which the lower phase consists of the crude elemental metal and the upper phase consists of one or more layers of molten slag in which the reactions leading to the crude elemental metal take place.

Above the liquid phase there is a gaseous phase produced by the oxidation and reduction reactions.

The temperatures are very high, and are generally determined by the need to keep the slag molten so as to favour mass transfer between the various liquid phases, and these temperatures can reach 1400°-1500° C.

The severity of the mechanical, chemical and thermal stresses to which these furnaces are subjected is therefore apparent.

The liquid slag and gaseous phase are extremely aggressive towards the construction material at the process temperatures, and therefore both the refractory and metal materials in contact with the process fluids must be either repaired or replaced periodically.

It it therefore obviously necessary either to construct all parts of the furnace so that they can be replaced without having to work on their adjacent parts, or to keep the structural parts at temperatures much lower than the process temperatures by means of cooling fluids.

Both the crude elemental metal and the liquid slag have very high specific gravities, and therefore a liquid phase head for example of only two meters can stress the hearth with a load equivalent to 10-20 metric tons per square meter.

The high temperatures create serious expansion and sealing problems, because the liquid phase is very fluid and able to infiltrate under the refractory components and, because of its higher density, to raise these so disturbing the hearth and the wall linings, which finish by floating on the liquid phase. It is therefore essential to construct such parts of the structure in a compact and impermeable manner.

Because of the toxicity and aggressiveness of the gaseous phase, the furnace must have excellent sealing characteristics and operate under slight vacuum, each gaseous discharge being controlled and conveyed to treatment plants.

The severity of these mechanical, chemical and thermal stresses means that furnaces for non-ferrous metal treatment are considerably limited in their dimensions and thus in their unit production capacity.

A further consequence of the severity of these stresses is the low furnace service factor, because of the frequent maintenance and renovation operations which such furnace require. These operations require the plant to cease operation for a considerable time, because the shutting-down and restarting of the furnace up to full operating conditions must be done very gradually.

DESCRIPTION OF THE DRAWINGS

The invention will be better illustrated with the aid of the accompanying drawings, wherein:

FIG. 4 is an overall layout of the installation;

FIG. 4A is a cross-section view taken along the line A—A of FIG. 4;

FIG. 4B is a cross-section view taken along the line B—B of FIG. 4;

FIG. 4C is a cross-section view taken along the line C—C of FIG. 4, and

FIG. 4D is a collective showing of the several materials used for the construction of the furnace, the numerals corresponding to those used in the specification for indicating the relative materials.

The furnace according to the present invention obviates the aforesaid limitations and consists of a tank furnace formed essentially of a rigid structural metal frame which encloses and supports the following structural parts, these being described hereinafter.

A—hearth

B—perimetral plate assemblies

C—metal belt for containing the process liquid phase

D—vertical walls and crown

The cross-section through the furnace is rectangular, the hearth being concave in the form of an inverted arch.

Figure 1:
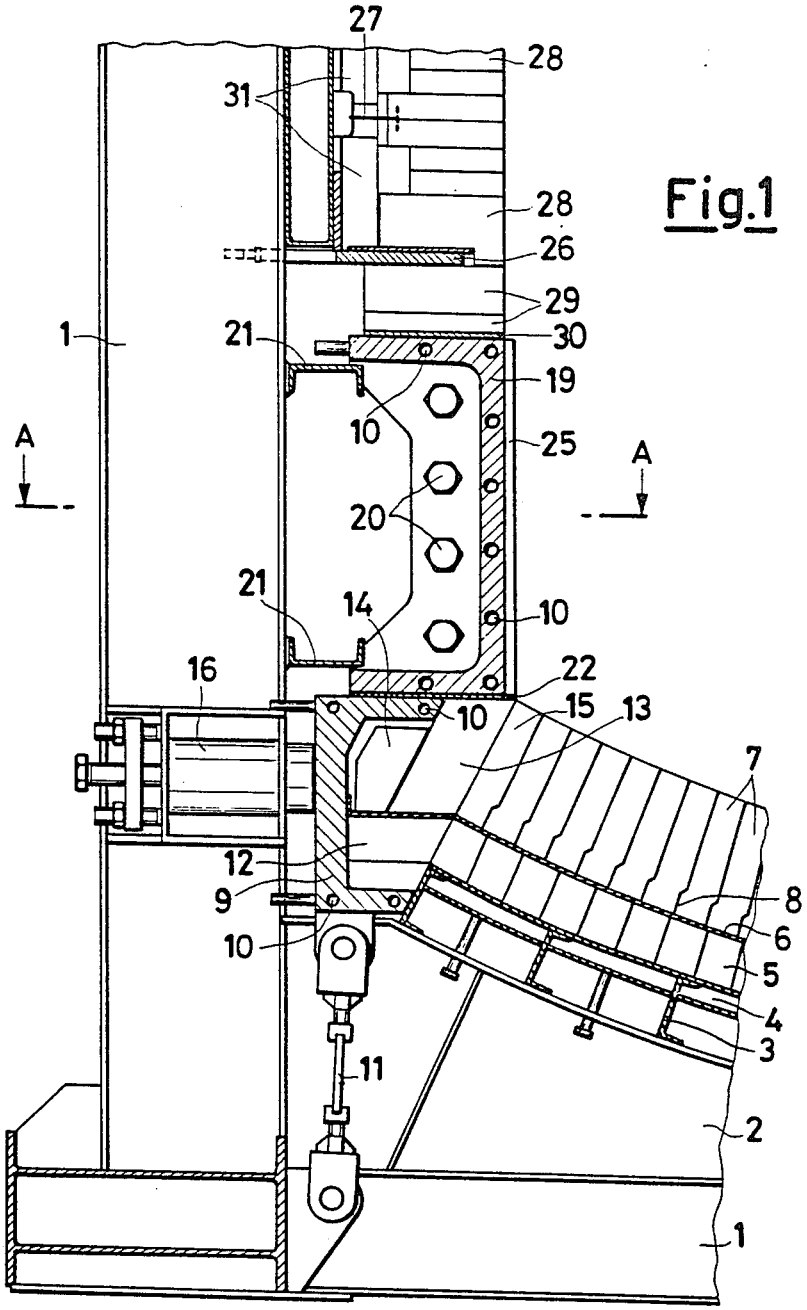
FIG. 1 is a showing, partly in view and partly in cross-section, of a side portion of the subject furnace.
Figure 2:
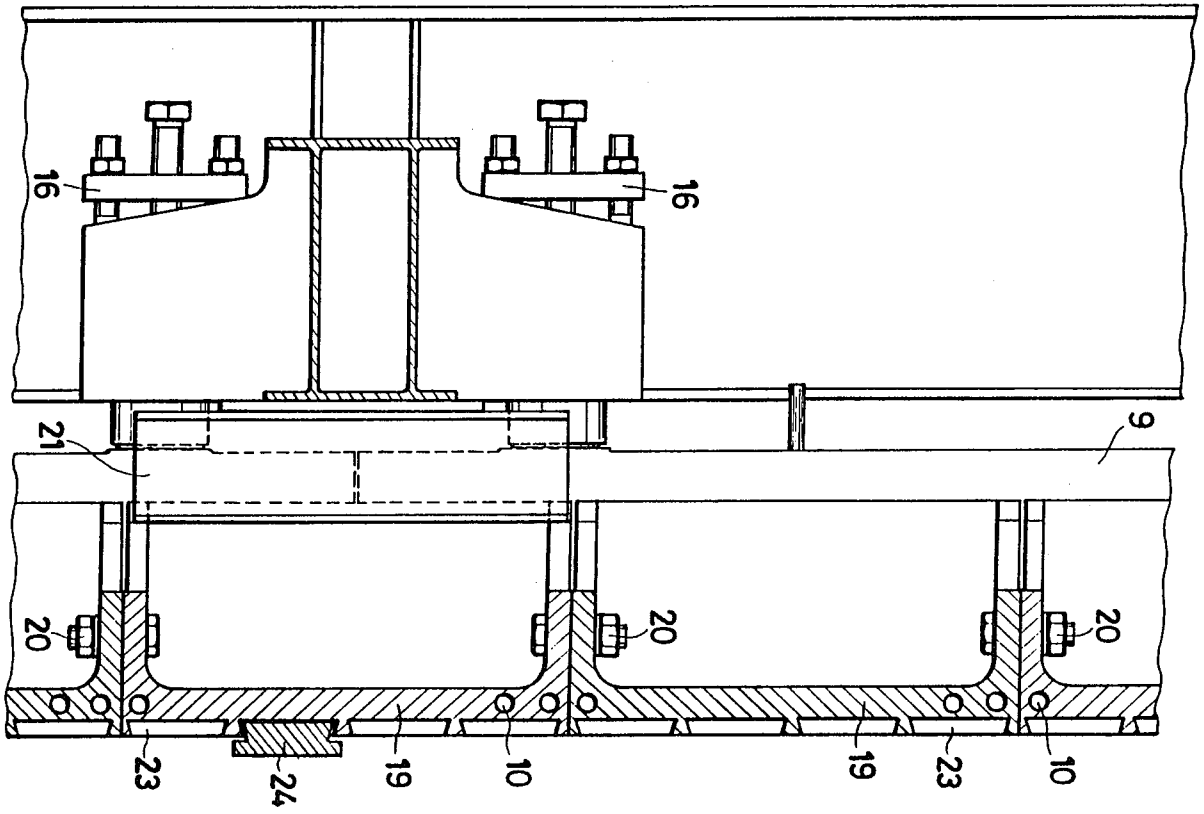
FIG. 2 is an enlarged fractionary cross-section view taken along the line A—A of FIG. 1.

FIG. 1 shows a section through the lower side wall of the furnace, and FIG. 2 is a plan view on the line AA.

The support frame 1 consists of a rigid lattice structure of horizontal and vertical steel beams.

A. Hearth

The furnace hearth consists of a series of saddles 2 disposed transversely, on which there rest a metal inverted arch structure 3 provided with longitudinal cooling ducts 4 through which cooling fluid is fed to keep the hearth structure at a temperature less than that of the overlying liquid metal. This fluid can be forced air.

On the metal structure 3 are laid a permanent layer 5 of graphite bricks and a metal seal plate 6 which acts as an apron for the upper inverted arch-shaped wear layer 7.

The layers 5 and 7 and the plate 6 extend into the perimetral plate assemblies which are described in the following paragraph. The wear layer 7 consists of refractory bricks, for example of the chrome-magnesia type, which behave as the quoins of an arch. In a preferred embodiment, the refractory bricks of the layer 7 are formed with one or more lateral butts 8 which engage in one or more coherent cavities in the opposite face of the adjacent brick. Any gaps between the bricks of the layer 7 can be sealed with refractory mortar, these depending on the accuracy of the brick faces.

B. Perimetral plate assemblies

Four plate assemblies 9 in the form of a large-thickness metal beam substantially of C-section are located at the base of the four vertical walls of the furnace.

Each plate assembly can be either integral or formed from a number of consecutive lengths.

Within the web of the beam there are provided longitudinal ducts 10 through which water is circulated under pressure in order to cool the plate assembly.

The plate assemblies 9 are connected to the base of the frame 1 by a plurality of hinged bars 11 which enable the plate assemblies to move horizontally in the plane of FIG. 1 under the thrust of the expansion of the hearth and in particular of the wear layer 7.

The permanent layer 5 of graphite bricks extends by means of the element 12 to a position close to the inner face of the plate assembly, as does the metal plate 6 which is bent over to adhere to this face.

The wear layer 7 continues with the elements 13 and 14, at which the plate 6 is bent upwards.

If a mortar cement grout has been applied between the bricks of the layer 7, this grout must preferably be omitted at the element 13 to allow slippage between said element 13 and the last element 15 of the wear layer 7 by thermal expansion. The element 15 has its upper face slightly depressed to allow it to slide under the metal belt described in the next paragraph, by the effect of thermal expansion.

The plate assemblies 9 are strongly compressed against the hearth by a plurality of elastic elements or reaction springs 16, which abut against the longitudinal members of the frame 1. The behaviour of the hearth under process conditions merits some consideration.

Because of the temperature variations, the hearth expands and contracts, but the effect of the thrust of the reaction springs 16 is such that the constituent components of the wear layer 7 are always kept compressed and properly adhering together.

The reaction springs 16 absorb the thermal contraction and expansion of the hearth without allowing gaps to form.

If on the other hand the crude elemental metal in the liquid state should find a gap between the interstices of the wear layer 7, it would be obstructed by the butts 8 which create a further labyrinth type seal.

If the liquid metal should reach the plate 6, it is unable to raise the bricks of the layer 7 because of the resistance offered both by the arched shape of the layer and by the butts 8.

Further guarantee is offered by the fact that as the permanent layer 5 is made of graphite, which is a good conductor of heat and is cooled by the air-cooled steel structure, the plate 6 is kept at a temperature below the solidification temperature of the metal, which therefore solidifies and exerts no further upward thrust on the bricks of the layer 7. Any peripheral infiltration at the elements 13 and 14 would solidify on contact with the plate 6 and plate assemblies 9, which are water-cooled through the ducts 10. As shown in the figures, the inverted crown of the refractory brick hearth does not bear on the two plate assemblies 9 in the position orthogonal to that shown in FIGS. 1 and 2, and which form the base of the end walls of the furnace.

The lunette which is exposed between the containing belt and the hearth is filled and protected with refractory bricks, which form a vertical wall laid on the hearth.

Figure 3:
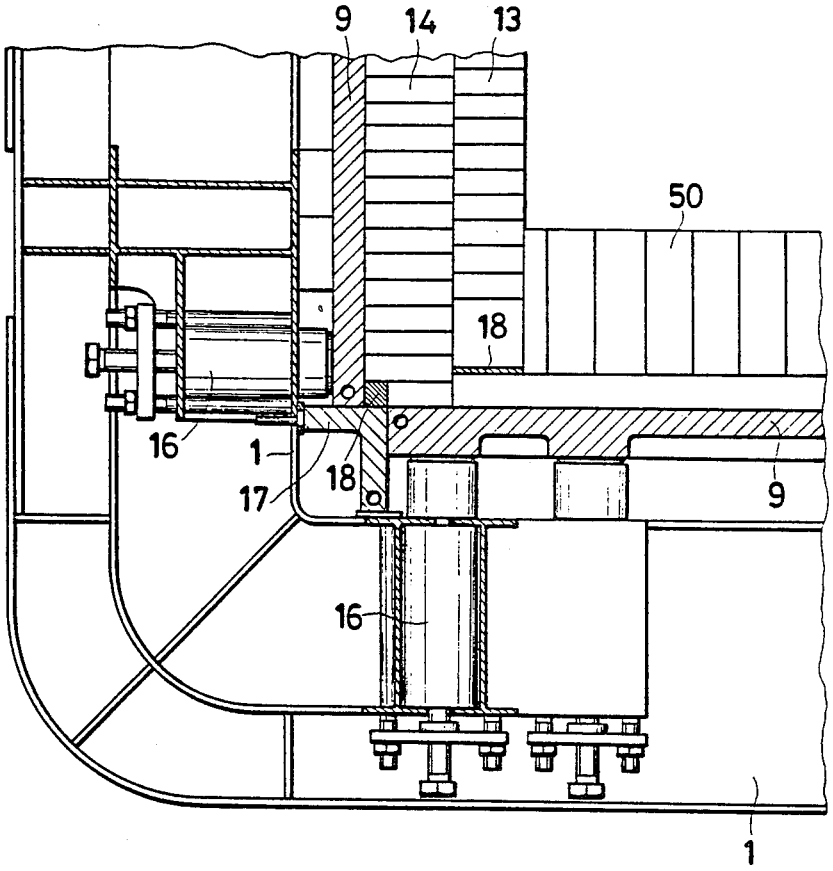
FIG. 3 is a view, partly in cross-section, of a portion of a corner zone of the furnace.

This structure can be seen in FIGS. 3 and 4 with the reference numeral 50.

The corner seals require separate mention. The metal plate assemblies 9, positioned on the four perimetral sides of the hearth, can move outwardly by the effect of thermal expansion. In their outward movement, they would create openings at the four corners, which result in gaps through which liquid metal could seep. As shown in FIG. 3, in order to provide a seal against the molten metal, four water-cooled steel angular elements 17 are installed at the four corners of the hearth and are rigidly fixed to the support frame 1.

In the last course of refractory bricks 13 and 14 forming the wear layer 7 and at the fixed corner elements, expansion spaces 18 are left in order to prevent thrusts being generated against these fixed elements. In a preferred embodiment, these spaces are occupied by a mineral wool gasket which absorbs the expansion.

C. Metal containing belt for the process liquid phase

The insert belt lying above the plate assemblies 9 represents the most stressed region of the furnace, both from a chemical aspect because it is in contact with the liquid slag which forms an extremely aggressive phase in which the chemical reduction reactions leading to the elemental metal take place, and from a structural aspect due to the lateral hydrostatic thrust and the thermal stresses, in that the liquid slag is the seat of intense heat transfer.

The metal containing belt is constructed of cast metal blocks 19 of hollow parallelepiped or box-panel form, provided with cooling ducts, again indicated by 10, through which water is fed under pressure.

FIG. 1 shows a single course of cast blocks 19, but the containing belt can consist of more than one course of blocks joined together vertically. The blocks 19 are joined rigidly together with seal gaskets interposed, by nuts and bolts 20 to form a rigid parallelogram which constitutes the load-bearing structure of the furnace perimeter and resists hydrostatic thrusts.

The cast blocks 19 are kept in position by a series of spacers 21, for example in the form of steel channel sections, fixed to the frame 1 to keep the containing belt formed by the blocks 19 fixed in a horizontal plane but allowing them a certain freedom of vertical movement to follow the movements of the plate assemblies 9.

The cast blocks 19 rest on the plate assemblies 9 by way of a gasket 22.

In a preferred embodiment of the present invention, the gasket 22 is constructed of graphite with a metal core which besides providing a seal for the molten bath allows suitable horizontal relative sliding between the containing belt—which remains fixed—and the metal plate assemblies which move by the effect of the hearth dilation due to thermal expansion.

In a preferred embodiment, the blocks 19 are constructed of copper or copper-based metal alloys.

On their outer face which faces the molten bath, the blocks 19 comprise a series of projections and slots 23, for example of dovetail shape, in which refractory tiles 24 with an inner profile corresponding to the slots 23 engage to form a layer 25 highly resistant to chemical attack by the liquid slag.

The height of the containing belt corresponds at least to the maximum level predicted for the process liquid phase.

D. Vertical walls and crown

The furnace side walls are constructed of chrome-magnesia refractory bricks above the metal belt described in the preceding paragraph. This masonry is supported by a series of horizontal ledges 26 which extend horizontally over the entire furnace wall but do not press on the containing belt. These ledges consist of metal channel or angle sections fixed to the support structure 1. The fixings 27 keep the brickwork in position. The ledges are preferably provided with a cooling system comprising ducts analogous to those of the blocks 19 through which water is circulated under pressure to remove the heat, so keeping the temperature of the ledges at contained levels.

The masonry is constructed of bricks 28.

The space between the metal belt and ledges 26 is sealed with chrome-magnesia bricks 29 after interposing a gasket 30 between the metal belt and the bricks 29 to ensure sealing and to allow any relative horizontal sliding by thermal expansion.

The brick course 29 can be easily removed to create operational spaces to allow the dismantling and replacement of deteriorated elements.

The lateral masonry above the ledges 26 forming the vertical walls is clad externally with insulating bricks 31 and then enclosed within the steel armour plating.

The crown is constructed of chrome-magnesia bricks and is divided into various sections by transverse joints to partly absorb expansion. Further thermal expansion of the crown is absorbed by the springs disposed about the perimeter.

For better illustration of the characteristics and advantages of the tank furnace according to the present invention, a description is given hereinafter by way of example of one embodiment thereof for treating lead ores with reference to FIG. 4, which shows a longitudinal section and three cross-sections through the furnace according to the invention.

The furnace is divided into three regions bounded by two vertical baffles 32 and 33 which are able to move vertically.

The maximum level of the liquid phase is represented by the dashed line 34 which at its maximum corresponds to the level of the containing belt, and the maximum level of the molten lead is represented by the dashed and dotted line 25 which corresponds to the level of the plate assemblies 9.

Proceeding from left to right through the longitudinal section, the three furnace regions are as follows:

The region 36 is used for evacuating the gas produced by the roasting and reduction of the mineral, the throughput of evacuated gas being regulated by the level of the vertical baffle 32. Regulating the reaction gas velocity enables its dust content and heat losses to be reduced.

The region 37 is used for roasting and for the main reduction of the ore. The lead ore, essentially galena, the carbon and the oxygen for supporting the reaction and for make-up of the slag materials are fed through the aperture 38.

The molten bath consists of oxides and sulphides, fluxes and reduced metals produced by the roasting and reduction of the charge, its temperature varying from 1200° to 1400° C.

An indicative composition of the liquid slag is as follows:

| | |
|---|---|
| CaO | 13–20% by weight |
| FeO | 25–35% by weight |
| $SiO_2$ | 25–35% by weight |
| PbO | 1–6% by weight |
| ZnO | 4–15% by weight |

An indicative composition of the gas and vapour above the molten bath in the regions 36 and 37 is as follows:

| | |
|---|---|
| $SO_2$ | 35–45% by weight |
| $CO_2$ | 18–28% by weight |
| PbO | 14–20% by weight |
| $O_2$ | 3–7% by weight |
| $N_2$ | 4–12% by weight |

The operating pressure is slightly less than the external pressure, being up to 10 mm $H_2O$ of vacuum.

The region 39 is used for completing the reduction reactions, which are supported by applying heat by means of electrodes 40 fed with electric current.

The gas blanket above the region 39 is separated from the regions 36 and 37 by the baffle 33 which is kept immersed in the molten bath. An indicative composition of its main gas phase components is as follows:

| | |
|---|---|
| $CO + CO_2$ | 15–25% by weight |
| Pb + PbO | 10–20% by weight |
| Zn + ZnO | 20–30% by weight |
| $N_2$ | 30–40% by weight |
| $O_2$ | 1–5% by weight |

The crude molten lead is withdrawn by overflow from the syphon 41. The discharge ports 42 are used for normal discharge of the liquid slag, and the discharge ports 43 are used for its emergency discharge.

In a preferred embodiment of the invention, in the cupola zones above the regions 36 and 37, the masonry is cooled by inserting metal elements 44, preferably of copper, in which cooling ducts are provided for the circulation of cooling fluid.

The materials indicatively used for the furnace construction are:

| | |
|---|---|
| 45 | chrome-magnesite |
| 46 | refractory clay |
| 47 | panel asbestos |
| 48 | chromite-periclase |
| 49 | graphite |

The lining 50 indicates the refractory wall protecting the lunette between the containing belt and the refractory hearth.

The advantages of the tank furnace according to the invention are apparent from the aforegoing description.

Of the main advantages, the following should be mentioned:

There are no substantial limitations on the unit capacity of the furnace according to the invention.

A single furnace can provide an annual production of crude elemental metal of the order of 100000 metric tons.

The metal containing structure for the molten bath ensures rigidity and sealing for the molten bath and for the liquid metal, as it is fixed and anchored to the load-bearing frame of the furnace.

The cast copper blocks which form the containing belts are easily removed without demolishing the overlying masonry.

The masonry forming the upper part of the furnace can expand independently of the steel support structure which remains fixed.

The refractory lining of the copper blocks on the process side ensures protection against chemical attack and a substantial reduction in heat loss.

The hearth construction is compact although being free to expand both longitudinally and transversely during start-up and operation, as it is kept compressed by expansion compensating springs.

Sealing against seepage of liquid metal, which under operating conditions has a very low viscosity, is ensured by the shape of the hearth, by its compression and by the cooling of the permanent hearth layer.

The ducts for the forced-air cooling of the hearth and the ducts for the pressurised-water cooling of the structural metal elements ensure temperature control of every part of the furnace.

The hearth, the plate assemblies, the containing belt and the overlying masonry are not joined together, and so are able to expand independently, ensuring a perfect seal and a long life.

The masonry is accessible from the outside for small repair work without interrupting the furnace production campaign.

The reaction chamber, ie the region 37, is physically separated from the gas evaporation chamber, ie the region 36, and expands independently thereof.

We claim:

1. A tank furnace for the metallurgical treatment of non-ferrous metals having an external support frame for supporting components which comprises side walls, a crown of refractory masonry connecting with said side walls, a rectangular hearth in the form of an inverted arch forming a bottom portion of the tank furnace, a perimetral metal plate assembly communicating with said hearth at said side walls, and adapted to move in the horizontal direction of expansion of the hearth said inverted arch shaped hearth being supported by said perimetral metal plate assembly, a metal structure forming a containing belt disposed on said perimetral metal plate assembly, a plurality of elastic elements or reaction springs operatively associated with said perimetral metal plate assembly and biased to compress said perimetral metal plate assembly against the hearth, and a plurality of hinged bars attached to the base of the external frame and supporting the perimetral metal plate assembly, said hinged bars enabling the plate assemblies to move in said horizontal direction.

2. The tank furnace as claimed in claim 1, wherein the furnace hearth rests on a series of transverse saddles and consists of the following layers, proceeding from the bottom upwards: a metal inverted arch structure, a permanent layer of graphite bricks, a metal seal plate, and a wear layer of refractory bricks.

3. A tank furnace as claimed in claim 2, characterised in that the metal inverted arch structure is provided with longitudinal cooling ducts through which cooling fluid, preferably forced air, is passed.

4. The tank furnace as claimed in claim 1, wherein the metal structure forming the containing belt consists of metal blocks having a hollow parallelepiped or box-panel configuration joined rigidly together to form a rigid parallelogram.

5. The tank furnace as claimed in claim 4, wherein the hollow parallelepiped metal blocks are provided with cooling ducts through which water flows under pressure.

6. The tank furnace as claimed in claim 4, wherein the metal structure forming the containing belt rests on the perimetral plate assemblies through the interposition of a graphite gasket in such a manner that it is free to slide horizontally relative to said plate assemblies, said containing belt being maintained in position by spacers fixed to the lattice structure forming the external support frame for the furnace.

7. The tank furnace as claimed in claim 1 wherein the side walls consist of refractory masonry supported by ledges connected to the structure of the external support frame, said refractory masonry not bearing on the containing belt, whereby it is able to expand freely relative thereto.

8. The tank furnace as claimed in claim 1 wherein the furance is divided into three regions, the first of which is used for gas evacuation, the second of which is used for ore roasting and reduction, and the third of which is used for electrothermal completion of the oxide reduction, said three regions being separated by vertical baffles of adjustable height, the first baffle separating the two first mentioned regions for regulating the gas phase flow, and the second baffle separating the two second mentioned regions, it being immersed in the molten bath and separating the gaseous atmosphere above the first region from the gaseous atmosphere above the third region

* * * * *

UNITED STATES PATENT AND TRADEMARK OFFICE

CERTIFICATE OF CORRECTION

PATENT NO. : 4,773,630

DATED : Sep. 27, 1988

INVENTOR(S) : Carminati et al

It is certified that error appears in the above-identified patent and that said Letters Patent is hereby corrected as shown below:

On the title page:

In the category "[73] Assignee:" change "Shamprogetti S.p.A., Milan, Italy" to --Snamprogetti S.p.A., Milan, Italy--

Signed and Sealed this

Eleventh Day of April, 1989

*Attest:*

*Attesting Officer*

DONALD J. QUIGG

*Commissioner of Patents and Trademarks*